US008695495B2

(12) United States Patent
Hashimoto

(10) Patent No.: US 8,695,495 B2
(45) Date of Patent: Apr. 15, 2014

(54) NAIL PRINT APPARATUS AND PRINT CONTROL METHOD

(75) Inventor: Shogo Hashimoto, Kawasaki (JP)

(73) Assignee: Casio Computer Co., Ltd., Tokyo (JP)

( * ) Notice: Subject to any disclaimer, the term of this patent is extended or adjusted under 35 U.S.C. 154(b) by 242 days.

(21) Appl. No.: 13/283,844

(22) Filed: Oct. 28, 2011

(65) Prior Publication Data

US 2012/0103210 A1 May 3, 2012

(30) Foreign Application Priority Data

Oct. 28, 2010 (JP) ..... 2010-241708

(51) Int. Cl.
*B41F 17/00* (2006.01)
*A45D 29/00* (2006.01)
*B41J 3/00* (2006.01)

(52) U.S. Cl.
USPC ..... 101/35; 101/41; 132/73; 132/200; 132/285; 347/2

(58) Field of Classification Search
USPC ..... 101/35, 41; 132/73, 73.5, 73.6, 74.5, 132/200, 285, 319; 347/2, 4; 434/100
See application file for complete search history.

(56) References Cited

U.S. PATENT DOCUMENTS

| | | | | | |
|---|---|---|---|---|---|
| 5,309,365 | A * | 5/1994 | Sullivan et al. | ..... | 700/161 |
| 5,931,166 | A * | 8/1999 | Weber et al. | ..... | 132/73 |
| 6,035,860 | A * | 3/2000 | Mombourquette | ..... | 132/200 |
| 6,065,969 | A * | 5/2000 | Rifkin et al. | ..... | 434/100 |
| 6,286,517 | B1 * | 9/2001 | Weber et al. | ..... | 132/73 |
| 6,336,694 | B1 * | 1/2002 | Ishizaka | ..... | 347/2 |
| 6,525,724 | B1 * | 2/2003 | Takami | ..... | 345/419 |
| 6,561,196 | B2 * | 5/2003 | Gamburg | ..... | 132/73 |

FOREIGN PATENT DOCUMENTS

| | | | | |
|---|---|---|---|---|
| JP | 2002-165632 | * 6/2002 | ..... | B41J 2/01 |
| JP | 2003-534083 A | 11/2003 | | |
| JP | 2012-005618 | * 6/2010 | ..... | A45D 29/00 |

* cited by examiner

*Primary Examiner* — Jill Culler
*Assistant Examiner* — Marissa Ferguson Samreth
(74) *Attorney, Agent, or Firm* — Holtz, Holtz, Goodman & Chick, PC

(57) ABSTRACT

Disclosed is a nail print apparatus including a storage unit in which a plurality of sets of data relating to a plurality of design parts constituting each of a plurality of design images are stored, a photographing unit which obtains a finger image by photographing a finger, a nail region information detection unit which extracts a nail region from the finger image and detects an area, a length in horizontal direction and a length in vertical direction of the nail region, a design selection unit which selects one design image from the design images which are stored in the storage unit, a part layout calculation unit which reads out the one design image and calculates a print size and a print position of each of the design parts, and a print unit which performs a printing to the nail region according to printing data.

4 Claims, 19 Drawing Sheets

| DESIGN PART No. | 1 | 2 | 3 | 4 |
|---|---|---|---|---|
| SIZE (%) | 20 | 28 | 28 | 20 |
| POSITION : x AXIS DIRECTION (%) | 50 | 5 | 80 | 45 |
| POSITION : y AXIS DIRECTION (%) | 15 | 40 | 70 | 95 |
| IMAGE DATA (bmp) | FLOWER-a | FLOWER-a | FLOWER-a | FLOWER-a |

| DESIGN PART No. | 1 | 2 | 3 |
|---|---|---|---|
| SIZE (%) | 30 | 27 | 34 |
| POSITION : x AXIS DIRECTION (%) | 8 | 60 | 75 |
| POSITION : y AXIS DIRECTION (%) | 70 | 90 | 12 |
| IMAGE DATA (bmp) | CHERRY BLOSSOM | CHERRY BLOSSOM | FLOWER-b |

| | |
|---|---|
| AREA : S (dot) | 21593 |
| HORIZONTAL WIDTH : W = LENGTH IN HORIZONTAL DIRECTION (x AXIS DIRECTION) (dot) | 115 |
| VERTICAL WIDTH : H = LENGTH IN VERTICAL DIRECTION (y AXIS DIRECTION) (dot) | 211 |

NAIL PRINT APPARATUS AND PRINT CONTROL METHOD

BACKGROUND OF THE INVENTION

1. Field of the Invention

The present invention relates to a nail print apparatus and a print control method.

2. Description of Related Art

Nail print apparatus is a print apparatus which prints colors and design images such as graphics on finger nails which are positioned by positioning the finger nails on which design images are to be printed on a finger mounting table provided on the apparatus main body. In such nail print apparatus, a user selects the design image which she/he wishes to print on her/his finger nails and the selected design image is to be printed on the region of nail portion (hereinafter called "nail region") of each finger.

Conventionally, there is known a nail print apparatus as shown in JP 2003-534083 in which a design image is stored in the storage unit as a piece of image data and which adopts a printing method in which the scaled down image of the entire image data is to be printed on each finger nail of a user by adjusting the scale according to the size, shape and the like of each nail region of the user.

However, when the scale of the entire image data of the design image is merely changed, each of the graphics included in the design image may be distorted and spaces between the graphic portions and the borderlines of the nail region may be excessively spaced or excessively narrow awkwardly.

In such case, the design image may fit in the nail region, however, the actual image printed in the nail region can be different from the image of the design image which is selected by a user. This can cause a problem that the design which the user desires and anticipates cannot be printed properly.

In such aspect, for example, if each of the graphics included in a design image can be adjusted finely by a user, such distortion of image can be prevented. However, such fine adjustment requires time and great care and is troublesome to a user.

SUMMARY OF THE INVENTION

In view of the above problems, a main object of the present invention is to provide a nail print apparatus and a print control method which can print a design as much as close to the image of the design image selected by a user on nail regions of the user automatically without causing trouble to the user.

In order to solve at least one of the above problems, a nail print apparatus according to the present invention includes a storage unit in which a plurality of sets of data relating to a plurality of design parts constituting each of a plurality of design images are stored, each set of data including size data, position data and image data which are made to correspond with each of the design parts, a photographing unit which obtains a finger image by photographing a finger, a nail region information detection unit which extracts a nail region from the finger image which is obtained by the photographing unit and detects an area, a length in horizontal direction and a length in vertical direction of the nail region, a design selection unit which selects one design image from the design images which are stored in the storage unit, a part layout calculation unit which reads out the one design image which is selected by the design selection unit from the storage unit and calculates a print size and a print position of each of the design parts based on the size data and the position data of each of the design parts included in the one design image which is read out and an area, the length in horizontal direction and the length in vertical direction of the nail region which is detected by the nail region information detection unit, and a print unit which performs a printing to the nail region according to printing data which is generated based on the print size and the print position of each of the design parts which are calculated by the part layout calculation unit and image data of each of the design parts included in the one design image which is read out from the storage unit.

Further, a print control method according to the present invention includes photographing a finger to obtain a finger image, detecting an area, a length in horizontal direction and a length in vertical direction of a nail region by extracting the nail region from the finger image which is obtained in the photographing, calculating a print size and a print position of each of a plurality of design parts included in one design image based on a size and a position of each of the design parts and the area, the length in horizontal direction and the length in vertical direction of the nail region which are detected in the detecting, when the one design image is selected in a storage unit in which a plurality of sets of data relating to the plurality of design parts constituting each of design images are stored wherein each set of data including size data, position data and image data which are made to correspond with each of the design parts and when the one design image is read out from the storage unit, and performing a printing to the nail region according to printing data which is generated based on the print size and the print position of each of the design parts which are calculated in the calculating and image data of each of the design parts included in the one design image which is read out from the storage unit.

According to the present invention, data of the design image constituted of a plurality of design parts to be printed on the nail region Ta is stored in a format where the size data, position data and image data are made to correspond with each of the design parts, and the print size and print position of each of the design parts can be calculated when adjusting the size and shape of the design image according to the area, the length in horizontal direction and the length in vertical direction of the nail region of the a user. Therefore, differently from the case where the entire design image is stored as one piece of data and the printing data is generated by changing the scale of the entire design image, the shape of each of the design parts dp can be prevented from being distorted and the positional relation between the design parts dp and the positional relation between each of the design parts dp and the end portions of the nail region Ta can be prevented form being changed, and there is an advantage that the design image can be printed on the nail region of a user being close to the image of the design image which is selected by a user.

BRIEF DESCRIPTION OF THE DRAWINGS

The above and other objects, advantages and features of the present invention will become more fully understood from the detailed description given herein below and the appended drawings which are given by way of illustration only, and thus are not intended as a definition of the limits of the present invention, and wherein.

DESCRIPTION OF THE PREFERRED EMBODIMENTS

An embodiment of a nail print apparatus according to the present invention will be described with reference to FIGS. 1 to 23.

Figure 1:
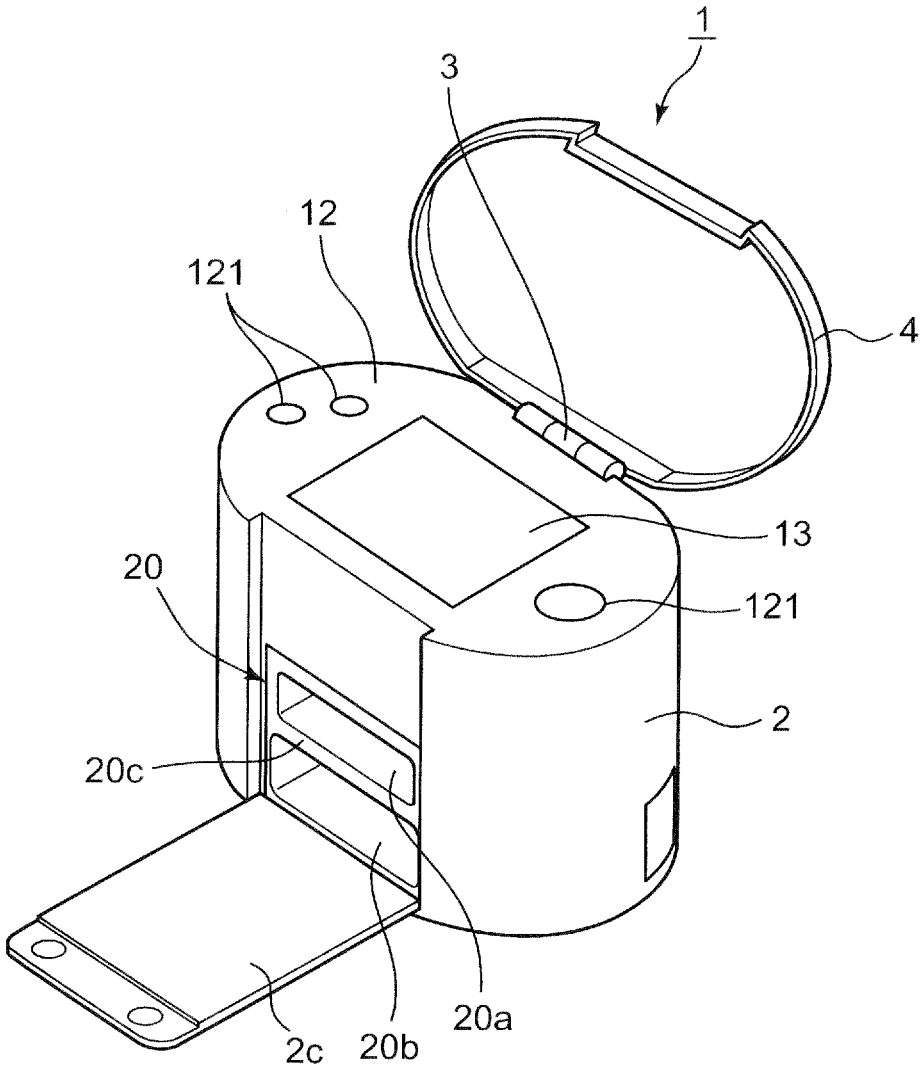
FIG. 1 is a schematic diagram conceptually showing an embodiment of a nail print apparatus according to the present invention, showing a state where the cover is opened.
Figure 2:
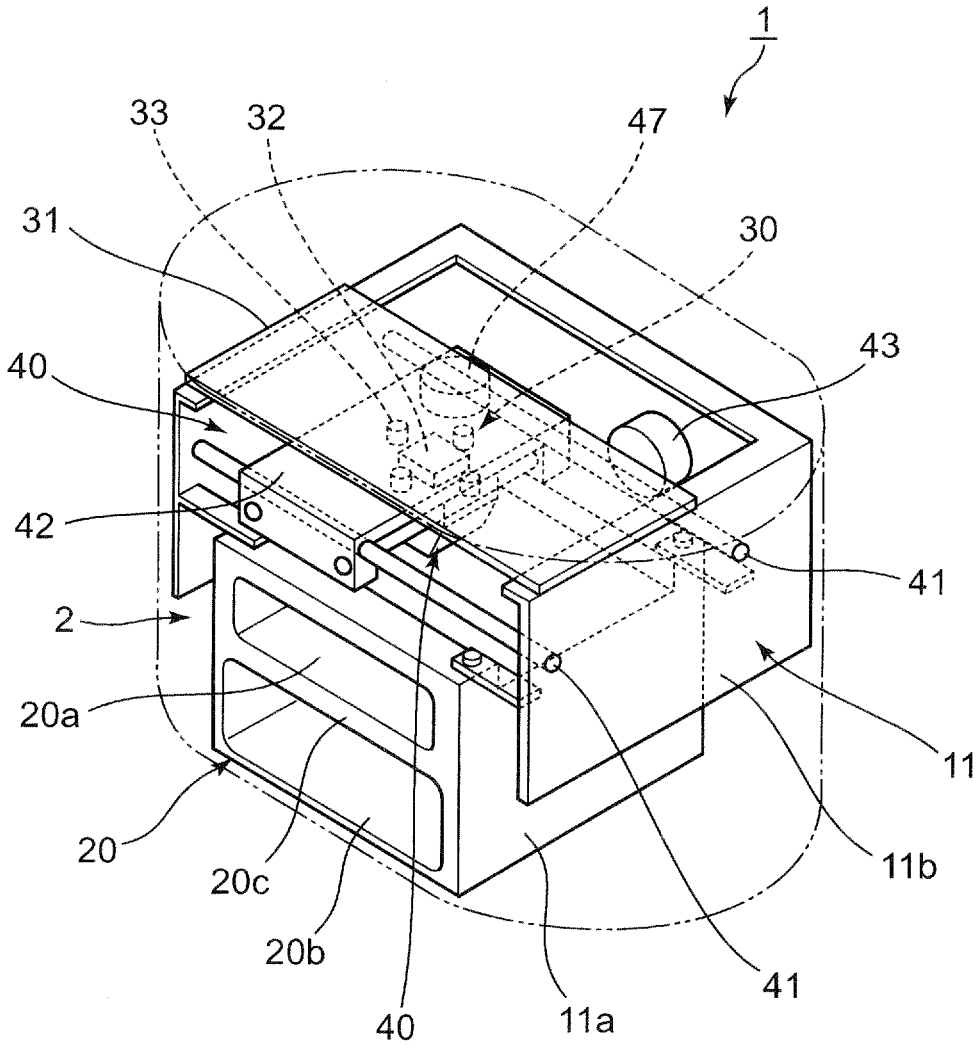
FIG. 2 is a schematic diagram conceptually showing an apparatus main body of the nail print apparatus of FIG. 1.

FIG. 1 is a schematic diagram showing an outer appearance of the nail print apparatus of the embodiment, and FIG. 2 is a schematic diagram showing an internal structure of the nail print apparatus.

As shown in FIG. 1, the nail print apparatus 1 includes a case body 2 and a cover 4. The case body 2 and the cover 4 are joined to each other via a hinge 3 provided at the upper surface back end portion of the case body 2.

The case body 2 is formed in an oval shape in a plan view. An open/close plate 2*c* which can rise and fall is provided on the front of the case body 2. The open/close plate 2*c* is joined to the case body 2 via a hinge (not shown in the drawing) provided on the front surface at lower end portion of the case body 2. The open/close plate 2*c* is to open and close the front side of the case body 2.

Moreover, the after-mentioned operation panel 12 is disposed on the top board 2*f* of the case body 2, and a display section 13 is disposed at an approximately center of the top board 2*f*.

Here, shapes and configurations of the case body 2 and the cover 4 are not limited to the above exemplified shapes and configurations.

The apparatus main body 10 of the nail print apparatus 1 is housed in the case body 2. The apparatus main body 10 includes a printing finger fixing section 20 shown in FIG. 2 which constitutes the printing finger fixing unit, a photographing section 30 shown in FIG. 2 which constitutes a photographing unit, a print section 40 shown in FIG. 2 which constitutes a print unit, and a control device 50 (see FIG. 8) which constitutes a control unit. The printing finger fixing section 20, photographing section 30, print section 40 and control device 50 are disposed inside of the machine frame 11.

Here, the machine frame 11 is constituted of a lower part machine frame 11*a* and an upper part machine frame 11*b*. The lower part machine frame 11*a* is formed in a box shape and is disposed inside of the case body 2 at lower part thereof. The upper part machine frame 11*b* is disposed inside of the case body 2 at upper part thereof and above the lower port machine frame 11*a*.

The printing finger fixing section 20 is provided in the lower part machine frame 11*a* of the machine frame 11. The printing finger fixing section 20 is constituted of the printing finger insertion section 20*a*, non-printing finger insertion section 20*b* and holding section 20*c* which are provided in the lower part machine frame 11*a*.

Here, the printing finger insertion section 20*a* is a finger insertion section for inserting the finger U1 (hereinafter called "printing fingers") corresponding to nails T on which printing is to be performed (see FIG. 3). The bottom face (printing finger mounting surface) of the printing finger insertion section 20*a* functions as the finger mounting unit where the printing fingers U1 are to be mounted. Photographing and printing of the printing fingers U1 are carried out in a state where the printing fingers U1 are mounted on the printing finger mounting surface of the printing finger insertion section 20*a* as the finger mounting unit.

Moreover, the non-printing finger insertion section 20*b* is a finger insertion section for inserting a finger U2 (hereinafter called "non-printing finger") other than the printing fingers (see FIG. 3).

The holding section 20*c* is a portion which can be held by being sandwiched by the printing fingers U1 inserted in the printing finger insertion section 20*a* and the non-printing finger U2 inserted in the non-printing finger insertion section 20*b*. In the embodiment, the holding section 20*c* is constituted of a partition 21 which separates the printing finger insertion section 20*a* and the non-printing finger insertion section 20*b* from each other.

The upper surface of the partition 21 constitutes the flat printing finger mounting surface. A bulged portion 22 is formed at the end of the partition 21 on the side from where the fingers are inserted. The bulged portion 22 is formed at the portion of the partition 21 where the base U3 of the printing fingers U1 and non-printing finger U2 contacts when the printing fingers U1 and the non-printing finger U2 are inserted deeply in the printing finger insertion section 20*a* and the non-printing finger insertion section 20*b*, respectively. The bulged portion 22 is formed so that the cross-section thereof in finger inserting direction forms a round shape bulging downward from the lower surface of the partition 21 so that the partition 21 (the holding section 20*c*) can be held firmly by being sandwiched by the printing fingers U1 and the non-printing finger U2 in a state where the entire balls of the printing fingers U1 contacting the printing finger mounting surface. Here, shape of the bulged portion 22 is not limited to the rounded cross-section shape. The bulged portion 22 may be formed in a non-circular shape such as an oval cross-section shape, a polygonal shape or the like.

Figure 3:
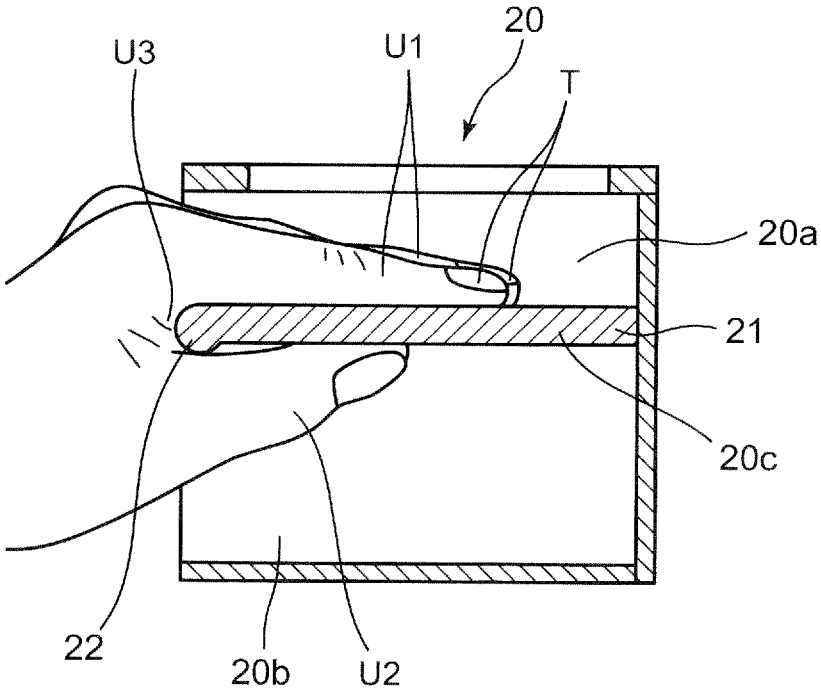
FIG. 3 is a cross-sectional diagram showing a printing finger fixing unit of the nail print apparatus of FIG. 1, showing a fixed state where fingers from index finger to little finger are inserted in the printing finger insertion section as printing fingers.

For example, in a case where the four fingers (index finger, middle finger, ring finger and little finger) of left hand other than the thumb are the printing fingers U1, a user inserts the four printing fingers U1 in the printing finger insertion section 20*a* and inserts the thumb which is the non-printing finger U2 in the non-printing finger insertion section 20*b* as shown in FIG. 3. In such case, the printing fingers U1 are fixed on the holding section 20*c* by the user holding the holding section 20*c* by sandwiching it with the printing fingers U1 inserted in the printing finger insertion section 20*a* and the non-printing finger U2 inserted in the non-printing finger insertion section 20*b*.

Further, in a case where the thumb is the printing finger U1, the thumb (the printing finger U1) is inserted in the printing finger insertion section 20*a* and the four fingers (the non-printing fingers U2) other than the thumb are inserted in the non-printing finger insertion section 20*b*. In such case, the printing finger U1 is also fixed by the user holding the holding section 20*b* by sandwiching the holding section 20*c* with the printing finger U1 and the non-printing fingers U2.

Figure 4:
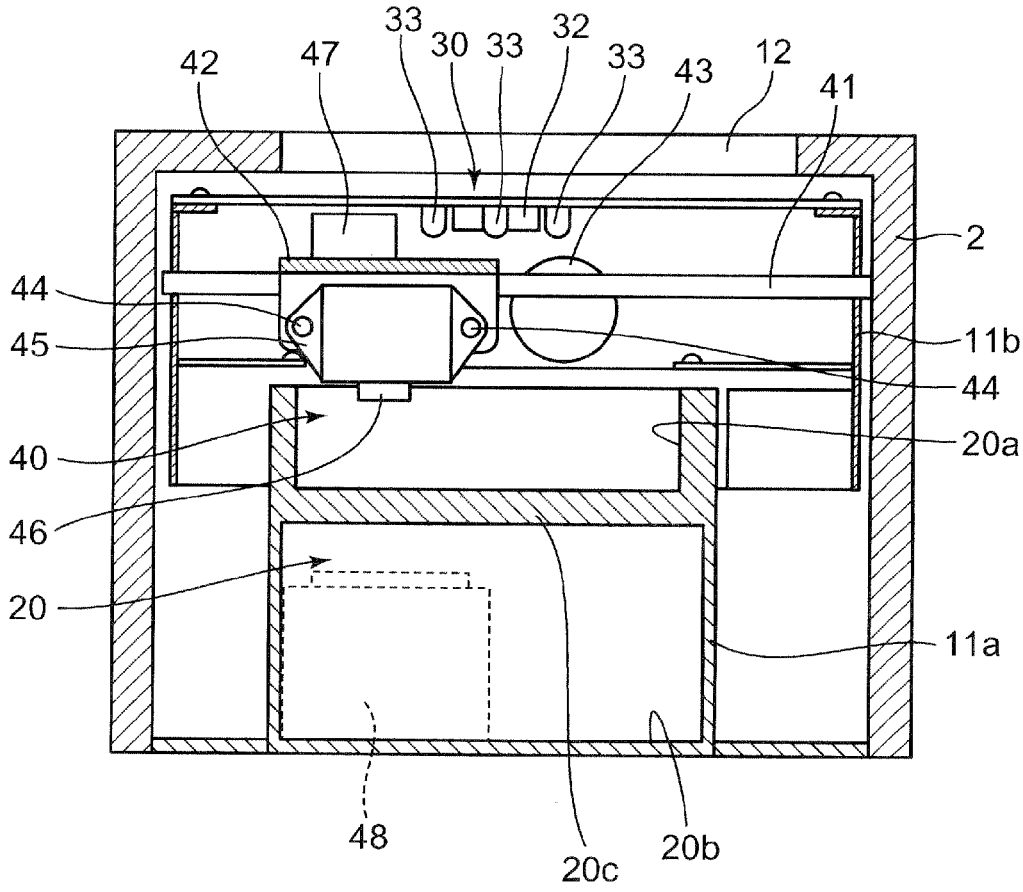
FIG. 4 is a cross-sectional diagram of the front side of the nail print apparatus of FIG. 1.
Figure 5:
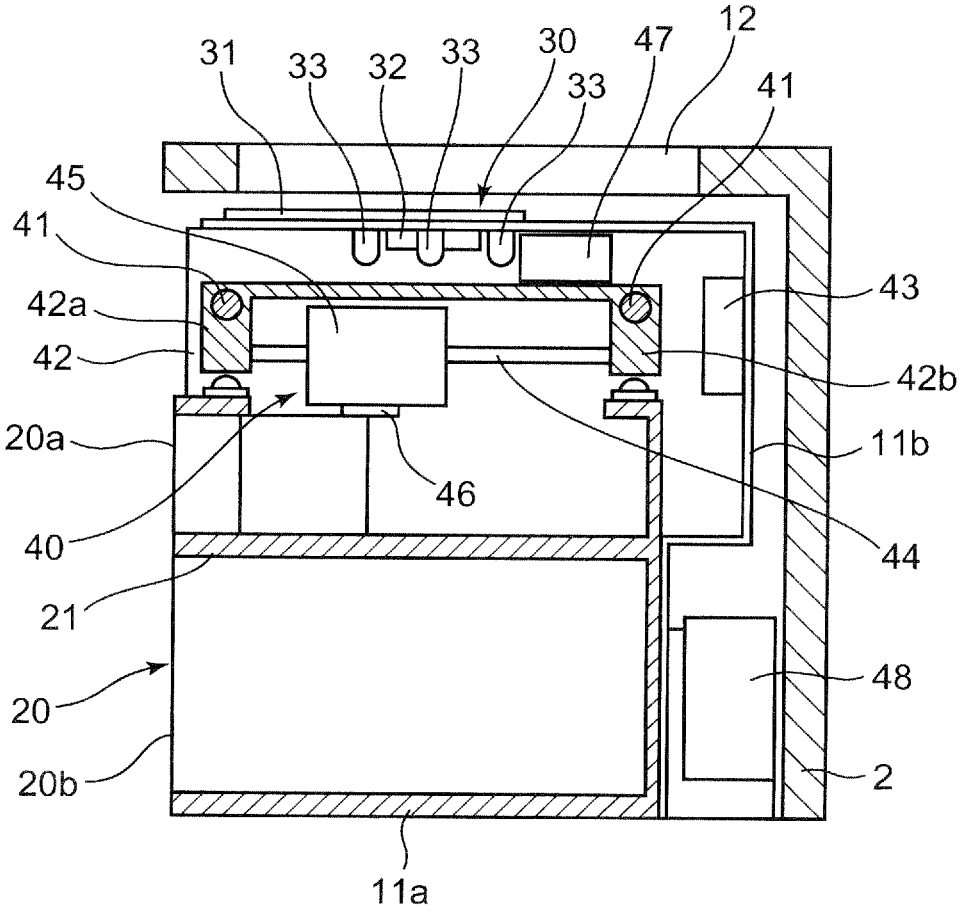
FIG. 5 is a side sectional view of the nail print apparatus of FIG. 1.

FIG. 4 is a cross-sectional diagram of the front side of the nail print apparatus 1 according to the embodiment, and FIG. 5 is a cross-sectional side diagram of the nail print apparatus 1.

As shown in FIGS. 4 and 5, the photographing section 30 is provided at the upper part machine frame 11*b* of the machine frame 11.

That is, a camera 32 with two million pixels or more, in which a driver is embedded is disposed at the center portion of the lower surface of the substrate 31 which is disposed on the upper part machine frame 11*b*. Further, illuminating lamps 33 such as white LED or the like are arranged at the substrate 31 so as to surround the camera 32. The photographing section 30 is configured by including the camera 32 and the illuminating lamps 33.

The photographing section 30 is the photographing unit for obtaining a finger image by lightening a printing finger U1 mounted in the printing finger insertion section 20*a* which is a finger mounting unit and photographing the printing fingers U1 by the camera 32. The photographing section 30 is connected to the after-mentioned main body control section 52 of the control device 50 and is controlled by the main body control section 52.

The print section 40 is a print unit to perform printing of colors and patterns on the nail region Ta (see FIG. 7 etc.) which is the print target region according to the printing data based on the coordinate values of the nail region Ta, and the print section 40 is provided mainly in the upper part machine frame 11*b*.

That is, as shown in FIGS. 4 and 5, two guide rods 41 are parallely bridged between both side plates of the upper part machine frame 11*b*. A main carriage 42 is attached to the guide rods 41 so as to slide. Further, as shown in FIG. 5, two guide rods 44 are parallely bridged between the front wall 42*a* and the back wall 42*b* of the main carriage 42. The secondary carriage 45 is attached to the guide rods 44 so as to slide. A print head 46 is mounted on the lower surface at the center portion of the secondary carriage 45.

In the embodiment, the print head 46 is an inkjet type print heat which performs printing by converting ink into minute droplets and directly spraying the ink droplets to the to-be-printed medium. Here, recording method of the print head 46 is not limited to the inkjet method.

The main carriage 42 is joined to the motor 43 via a power transmission unit (not shown in the drawing), and the main carriage 42 is configured so as to move in left and right directions along the guide rods 41 by the positive rotation and inverse rotation of the motor 43. Further, the secondary carriage 45 is joined to the motor 47 via a power transmission unit (not shown in the drawing), and the secondary carriage 45 is configured so as to move in front and back directions along the guide rods 44 by the positive rotation and inverse rotation of the motor 47.

Moreover, an ink cartridge 48 for supplying ink to the print head 46 is provided at the lower part machine frame 11*a*. The ink cartridge 48 is connected to the print head 46 via an ink supply tube (not shown in the drawing) to accordingly supply ink to the print head 46. Here, the ink cartridge may be mounted on the print head 46 itself.

The print section 40 includes the guide rods 41, the main carriage 42, the motor 43, the guide rods 44, the secondary carriage 45, the print head 46, the motor 47 and the ink cartridge 48. The motor 43, print head 46 and motor 47 of the print section 40 are connected to the after-mentioned main body control section 52 of the control device 50 and are controlled by the main body control section 52.

The operation panel 12 is an input unit for a user to perform various types of inputs.

For example, a power switch button to turn on the power of the nail print apparatus 1, a stop switch button to stop the operation, operation buttons 121 to perform other various types of inputs are arranged on the operation panel 12.

Figure 6:
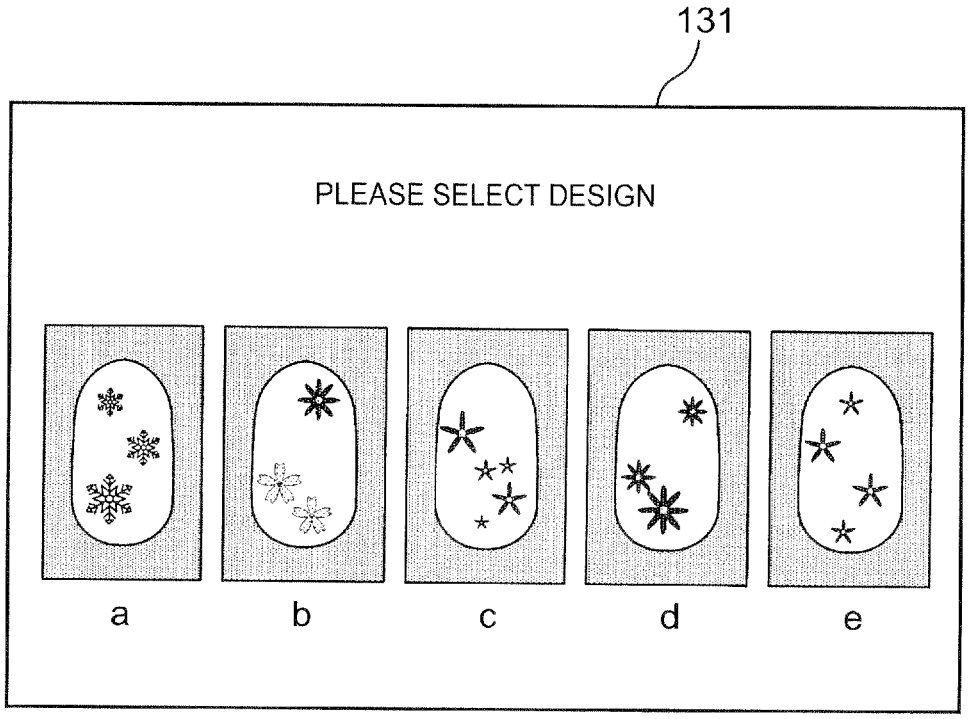
FIG. 6 is a diagram showing an example of a design selection screen.

In the embodiment, one of the operation buttons 121 functions as a design selection unit for selecting one design image from a plurality of design images stored in the after-mentioned design data storage section 511 of the storage section 51. That is, a design selection screen 131 is to be displayed in the display section 13 as shown in FIG. 6, and the design image to be printed is selected by a user selecting an alphabet corresponding to the desired design image by the operating buttons 121.

The display section 13 is a display unit constituted of a liquid crystal panel (liquid crystal display (LCD)) or the like, for example.

Here, a touch panel may be integrally provided on the surface of the display section 13. In such case, various types of inputs can be performed by touching the surface of the display section 13 by touching operations of a stylus pen, finger tip or the like which are not shown in the drawing.

In the display section 13, for example, a finger image which is the photographed image of a printing finger U1 and the nail region Ta thereof, a nail image pattern which is to be printed on the nail region Ta of the printing finger U1, a thumbnail image for design confirmation and the like are to be displayed.

Moreover, as described above, the design selection screen 131 shown in FIG. 6 is to be displayed in the display section 13. In the embodiment, a design image can be selected from five types of design images which are the design images a to e, and for example, the design images a to e are displayed side by side in the design selection screen 131.

Here, when a touch panel is integrally provided on the surface of the display section 13, a design image can be selected as the design image to be printed by a user merely touching the desired design image.

Figure 7:
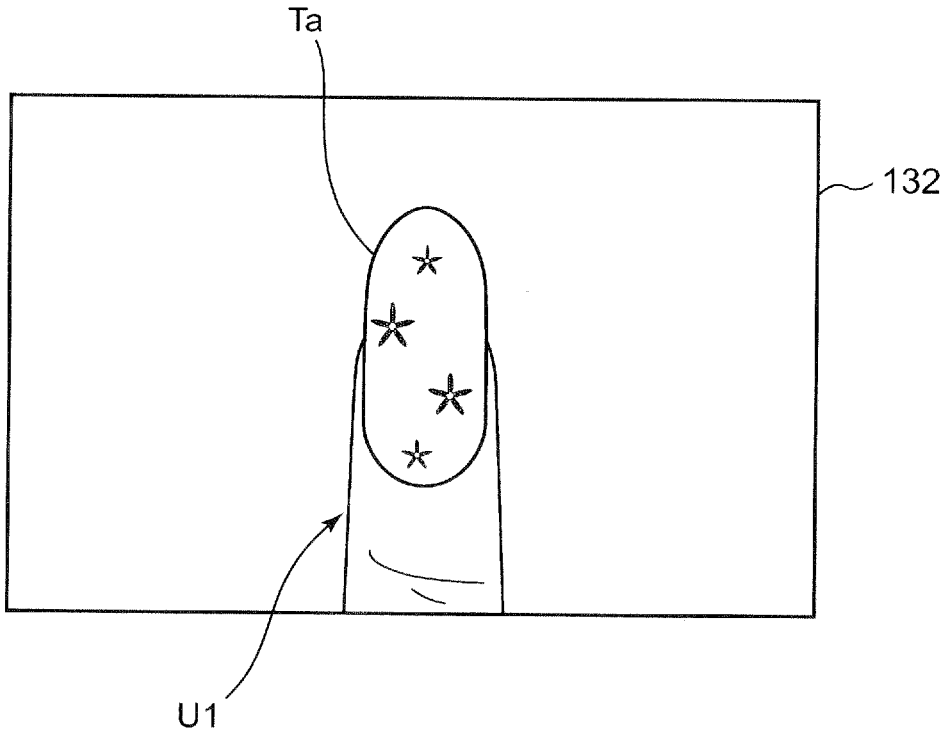
FIG. 7 is a diagram showing an example of a design confirmation screen.

Moreover, the design confirmation screen 132 as shown in FIG. 7 is displayed in the display section 13. In the design confirmation screen 132, the design image which is selected by a user is superimposed on the nail region Ta of the user's finger image. The overall size of the design image and the print size and print position of each design parts dp of the design image displayed in the design confirmation screen 132 are adjusted by the after-mentioned control device 50 so as to match the nail region Ta of the user. The user can confirm the final print image by the design confirmation screen 132. The user confirms the final design to be printed on the nail region Ta by the design confirmation screen 132 and if the user agrees to print as it is, the user operates the operation button 121 which instructs to start (execute) printing. Further, when the design image is to be changed, the screen returns to the design selection screen 131 (see FIG. 6) by operating the operation button 121 which instructs to changing of the design.

When a touch panel is integrally provided on the surface of the display section 13, it may be configured that the process to print the design image will be started merely by a user touching the design confirmation screen 132 or may be configured so as to display the operation buttons 121 such as an OK button on the screen and the process to print the design image will be started merely by a user touching the button.

Figure 8:
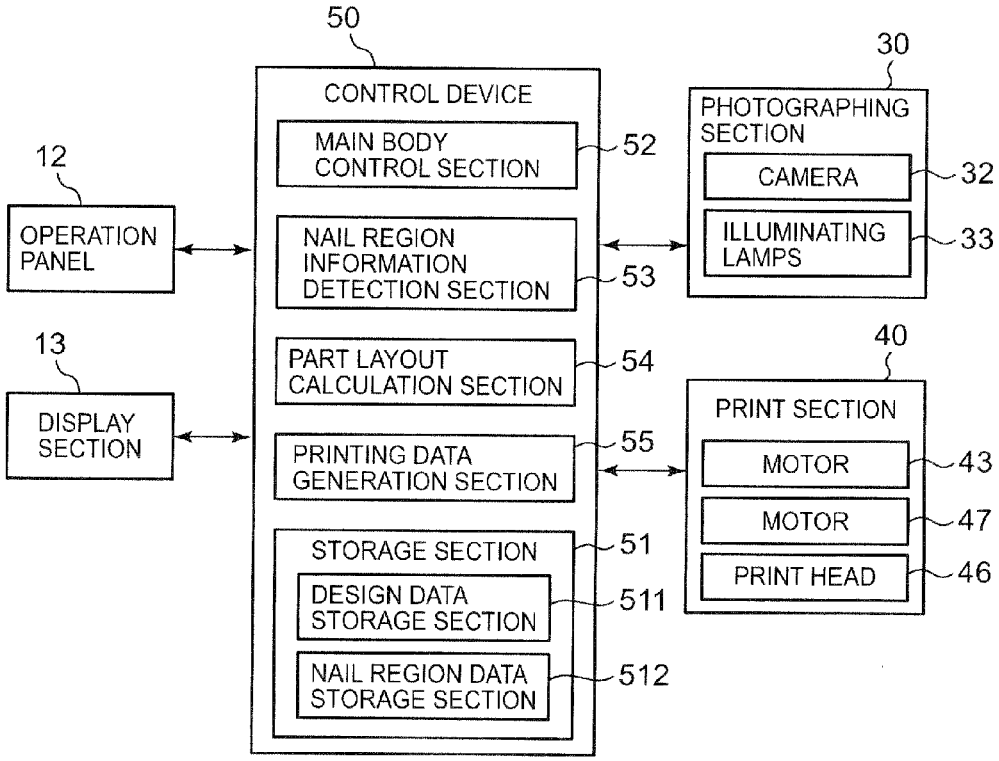
FIG. 8 is a main portion block diagram showing a control structure of the nail print apparatus according to the embodiment.

The control device 50 is disposed at the substrate 31 or the like arranged on the upper part machine frame 11*b*, for example. FIG. 8 is a main part block diagram showing the control structure of the embodiment.

The control device 50 is a computer including a storage section 51 constituted of ROM (Read Only Memory), RAM (Random Access Memory) (both are not shown in the drawing) and the like other than the CPU (Central Processing Unit) which is not shown in the drawing.

In the storage section 51, various types of programs such as a nail region extracting program to extract a nail region, a part layout calculation program to calculate print size and print position of a design part, a printing data generation program to generate printing data, a print program to perform printing process and the like. The control device 50 controls each part of the nail print apparatus 1 by executing the above programs.

Moreover, in the embodiment, a design data storage section 511 to store data related to design images is provided in the storage section 51.

The design data storage section 511 is constituted of a plurality of design parts dp and is a storage unit to store a plurality of design image sets in which size data, position data and image data are corresponded to each of the design parts dp in the design images.

Figures 9, 10:
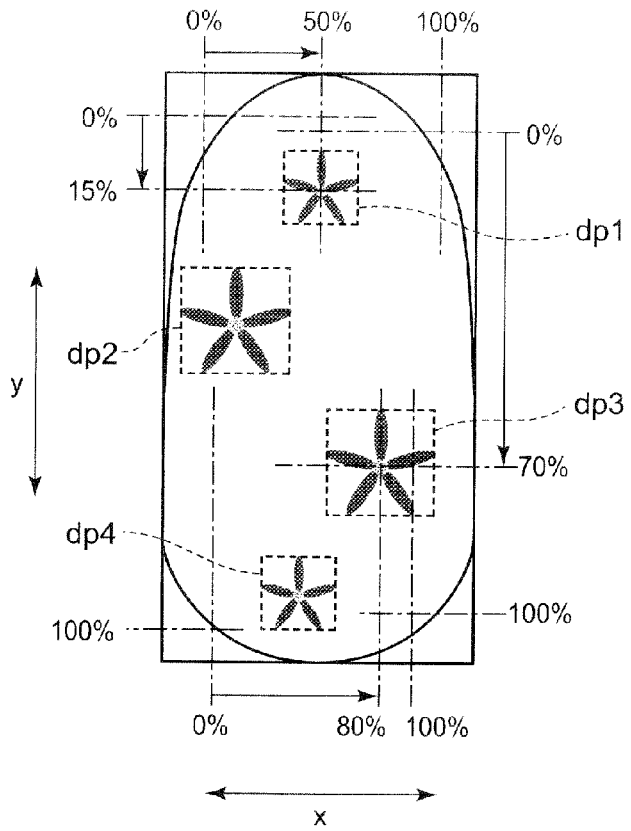
FIG. 9 is a diagram showing an arrangement of design image e on a standard nail model.
FIG. 10 is a diagram showing and example of data organization of the design image e.

FIG. 9 is an explanatory diagram showing an example of a structure of the design image e of FIG. 6, and FIG. 10 is a table which shows an example of data organization relating to the design image e shown in FIG. 9.

The design image e is constituted of four design parts dp No. 1 to No. 4. As shown in FIG. 10, the size data, position data and image data are made to correspond with each design part db and stored in the design data storage section 511.

The size data of each design part dp is a relative area ratio of the area of each design part dp and the area of standard nail model when the design image is arranged on the nail region (standard nail model) of an ideal shape, and the e size data of each design part dp specifies the size of each design part in terms of area ratio of each design part when the area of standard nail model is set to 100%. For example, when the area of standard nail model is set to 100%, the size of the design part dp No. 1 is 20% and the size of the design part dp No. 2 is 28%.

The position data of each design part dp specifies the position of each design part dp in terms of relative positional relation when the length in horizontal direction (x axis direction) and the length in vertical direction (y axis direction) of the standard nail model are set as the standard.

Figure 11:
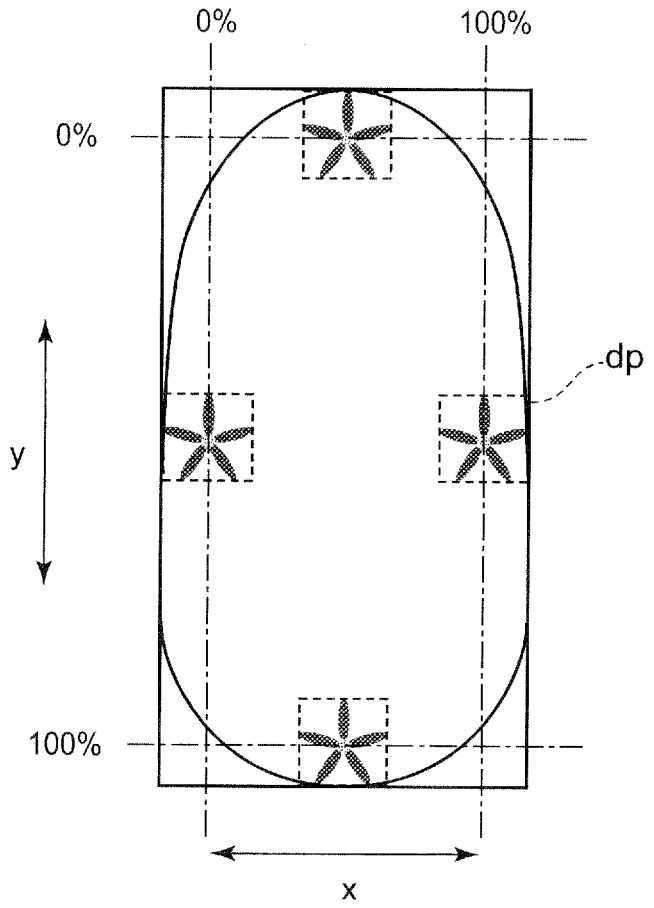
FIG. 11 is an explanatory diagram for explaining how to set 0% positions and 100% positions of the design part No. 1 of the design image e in horizontal direction and vertical direction.
Figure 12:
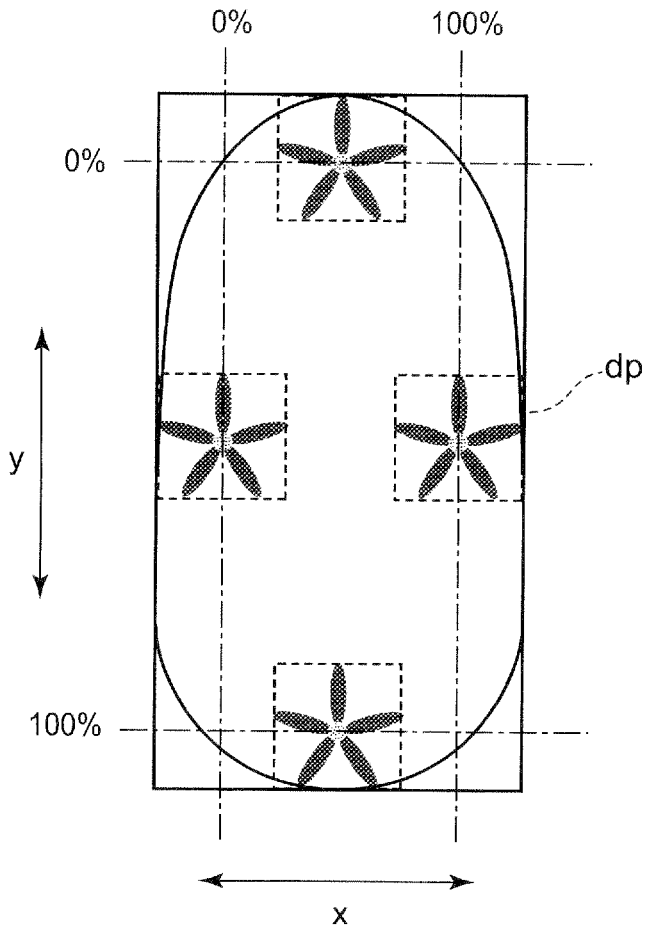
FIG. 12 is an explanatory diagram for explaining how to set 0% positions and 100% positions of the design part No. 3 of the design image e in horizontal direction and vertical direction.

As shown in FIGS. 11 and 12, the left, right, top and bottom of the standard nail model is encircled by a frame in the embodiment, and the position of each design part dp in horizontal direction (x axis direction) is a relative position when the position where the center of the design part dp be arranged is set as 0% when the design part dp is arranged on the standard nail model so that the left end of the design part dp overlaps and matches the left end of the frame of the standard nail model and when the position where the center of the design part dp be arranged is set as 100% when the design part dp is arranged on the standard nail model so that the right end of the design part dp overlaps and matches the right end of the frame of the standard nail model.

Similarly, the position of each design part dp in vertical direction (y axis direction) is a relative position when the position where the center of the design part dp be arranged is set as 0% when the design part dp is arranged on the standard nail model so that the upper end of the design part dp overlaps and matches the upper end of the frame of the standard nail model and when the position where the center of the design part dp be arranged is set as 100% when the design part dp is arranged on the standard nail model so that the lower end of the design part dp overlaps and matches the lower end of the frame of the standard nail model.

Here, the positions to be set as 0% and the positions to be set as 100% in horizontal direction (x axis direction) and vertical direction (y axis direction) vary according to the size of each design part dp.

That is, as shown in FIGS. 11 and 12, the distance from the center to the end of the design part dp differs according to the size of the design parts dp. When the design part dp (for example, the design parts dp No. 1 and No. 4 in FIGS. 9 and 10) is in a small size, the distance from the center to the end of the design part dp will be short and the position to be set as 0% and the position to be set as 100% will be at positions close to the ends of the frame of the standard nail model (see FIG. 11). On the other hand, when the design part dp (for example, the design parts dp No. 2 and No. 3 in FIGS. 9 and 10) is in a large size, the distance from the center to the end of the design part dp will be longer comparing to that in the design part dp of a small size and the position to be set as 0% and the position to be set as 100% will be at positions distanced from the ends of the frame of the standard nail model (see FIG. 12).

In FIG. 9, the relative position of the design part dp No. 1 within the range of 0% to 100% in horizontal direction (x axis direction) and vertical direction (y axis direction) is shown in dashed lines, and the relative position of the design part dp No. 3 within the range of 0% to 100% in horizontal direction (x axis direction) and vertical direction (y axis direction) is shown in double-dotted lines.

As shown in FIGS. 9 and 10, among the design parts dp constituting the design image e of the embodiment, the design part dp No. 1 is arranged at the 50% position in horizontal direction (x axis direction) and at the 15% position in vertical direction (y axis direction) on the standard nail model. Further, the design part dp No. 3 is arranged as the 80% position in horizontal direction (x axis direction) and at the 70% position in vertical direction (y axis direction) on the standard nail model.

Image data is data of the graphic itself of each design part dp, and for example, image data such as flower graphic, cherry blossom graphic (for example, in case of design image b), snow flake graphic (for example, in case of design image a) and the like are stored as bitmap data (bmp). Here, data format of image data is not limited to bitmap data (bmp), and image data can be stored in other data formats.

Figures 13, 14:
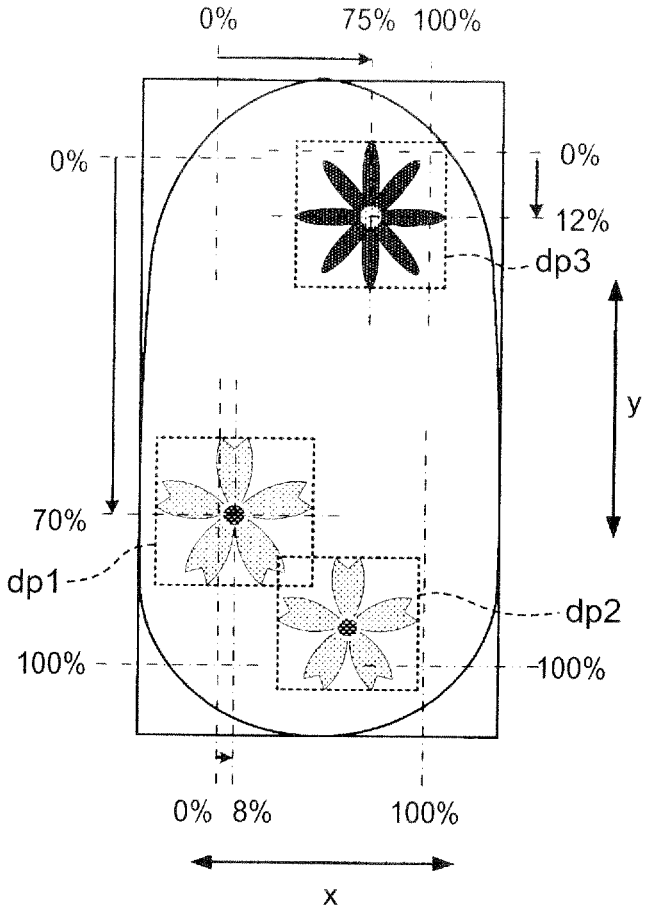
FIG. 13 is a diagram showing an arrangement of design image b on the standard nail model.
FIG. 14 is a diagram showing an example of data organization of the design image b.

For example, FIG. 13 is an explanatory diagram showing a structure example of the design image b of FIG. 6, and FIG. 14 is a table showing an example of data organization relating to the design image b shown of FIG. 13.

The design image b is constituted of three design parts dp No. 1 to No. 3, and size data, position data and image data are made to correspond with each design part and stored in the design data storage section 511 as shown in FIG. 14.

In FIG. 13, the relative position of the design part dp No. 1 within the range of 0% to 100% in horizontal direction (x axis direction) and vertical direction (y axis direction) is shown in dashed lines, and the relative position of the design part dp No. 3 within the range of 0% to 100% in horizontal direction (x axis direction) and vertical direction (y axis direction) is shown in double-dashed lines.

Here, the way of setting the positions to be 0% and the positions to be 100% in horizontal direction (x axis direction) position and vertical direction (y axis direction) position for each design part dp is the same as in the case of the design image e (see FIGS. 11 and 12). Therefore, the description is omitted.

As shown in FIGS. 13 and 14, among the design parts dp constituting the design image b of the embodiment, the image data of the design part dp No. 1 is a cherry blossom graphic and its size is 30%. Further, the design part dp No. 1 is to be arranges at the 8% position in horizontal direction (x axis direction) and at the 70% position in vertical direction (y axis direction) on the standard nail model.

Moreover, the image data of the design part dp No. 3 is a flower-b graphic and its size is 34%. Further, the design part dp No. 3 is arranged at the 75% position in horizontal direction (x axis direction) and at the 12% position in vertical direction (y axis direction) on the standard nail model.

In the embodiment, a nail region data storage section 512 for storing the area, length in horizontal direction and length in vertical direction of the nail region Ta which are the nail region information of the nail region Ta (see FIG. 16) extracted from the finger image of the printing finger U1 of a user obtained by the photographing section 30 is provided in the storage section 51. Here, in FIG. 16, the entire printing finger U1 is shown in double-dashed lines for the convenience of illustration.

Figures 16, 17:
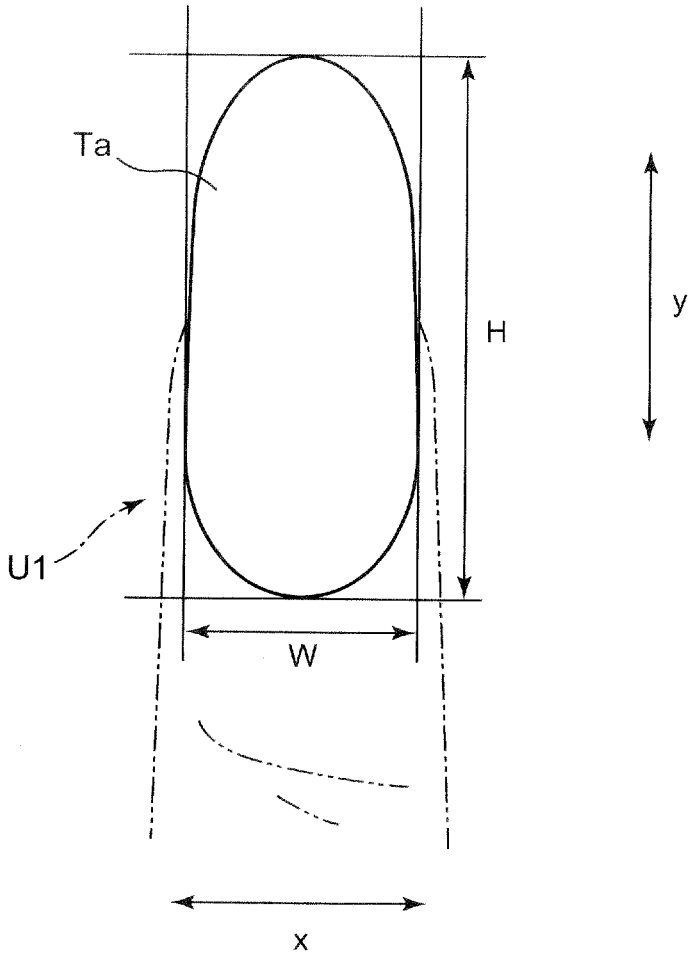
FIG. 16 is a diagram showing an example of a nail region.
FIG. 17 is a diagram showing an example of data organization of nail region information of the nail region of FIG. 16.

FIG. 17 is a diagram showing an example of nail region information stored in the nail region data storage section 512. In the embodiment, area (S) of the nail region Ta expresses the area of nail region Ta in number of dots constituting the nail region Ta as shown in FIG. 17. In the embodiment, a case where the nail region Ta is constituted of 21,593 dots is shown as an example.

Further, as shown in FIGS. 16 and 17, length (horizontal width: W) in horizontal direction expresses the length of the nail region Ta in horizontal direction (x axis direction) in number of dots. In the embodiment, a case where the number of dots in horizontal direction of the nail region Ta is 115 dots is shown as an example.

Furthermore, as shown in FIGS. 16 and 17, length (vertical width: H) in vertical direction expresses the length of the nail region Ta in vertical direction (y axis direction) in number of dots. In the embodiment, a case where the number of dots in vertical direction of the nail region Ta is 211 dots is shown as an example.

In the embodiment, the control device 50 includes functional sections such as the main body control section 52, a nail region information detection section 53, a part layout calculation section 54, a printing data generation section 55 and the like.

The main body control section 52 is a functional section to integrally control the entire nail print apparatus 1.

In the embodiment, the main body control section 52 controls the photographing section 30 to photograph a printing finger U1 of a user and obtains the finger image thereof. Further, the main body control section 52 outputs printing data generated by the after-mentioned printing data generation section 55 to the print section 40, and functions as a print control unit to control the print section 40 so as to perform printing to a nail region Ta according to the printing data.

The nail region information detection section 53 is a nail region information detection unit which extracts a nail region Ta from the finger image obtained by the photographing section 40 and detects the area (S), length (W) in horizontal direction (x axis direction) and length (H) in vertical direction (y axis direction) of the nail region Ta.

The detection result of the nail region information detection unit 53 is transmitted to the nail region data storage section 512 of the storage section 51 to be stored.

The part layout calculation section 54 is a part layout calculation unit which reads out the design image which is selected by the design selection unit such as an operation button 121 of the operation panel 12 or the like from the design data storage section 511 of the storage section 51, and which calculates the printing size and printing position of each design part dp according to the size data and position data of each design part dp included in the read out design image and the area, length in horizontal direction and length in vertical direction of the nail region Ta which is detected by the nail region information detection section 53.

The part layout calculation section 54 substitutes the area, length in horizontal direction and length in vertical direction of the standard nail model with the area, length in horizontal direction and length in vertical direction of the nail region Ta of the printing finger U1 of a user which is detected by the nail region information detection section 53 and calculates the print size and print position of each design part dp.

That is, for example, the size of the design part dp No. 1 of the design image e on the standard nail model is 20%. Therefore, the part layout calculation section 54 calculates the size (number of dots) which is 20% with respect to the area (S) of the nail region Ta of the printing finger U1, and this size becomes the print size of the design part dp.

Further, the design part dp No. 1 is arranged at the 50% position in horizontal direction (x axis direction) and at the 15% position in vertical direction (y axis direction) on the standard nail model. Therefore, the part layout calculation section 54 calculates the position which is at 50% in horizontal direction (x axis direction) and 15% in vertical direction (y axis direction) in the nail region Ta of the printing finger U1.

Here, the position to be 0% and the position to be 100% varies according to the size of the design part dp. Therefore, first, the left, right, top and bottom of the nail region Ta of the printing finger U1 is encircled by a frame, and then the design part dp in the print size calculated as described above is arranged on the nail region Ta so that the left end of the design part dp overlaps and matches the left end of the frame of the nail region Ta. At this time, the position where the center of the design part dp be arranged is set as 0%. Further, when the design part dp is arranged on the nail region Ta so that the right end of the design part dp overlaps and matches the right end of the frame of the nail region Ta, the position where the center of the design part dp be arranged is set as 100%. Similarly, the position to be 0% and the position to be 100% are also set for vertical direction (y axis direction).

In the case of the design part dp No. 1, the design part dp No. 1 is arranged so that the center of the design part dp positions at the 50% position within the range of 0% to 100% on the nail region Ta in horizontal direction (x axis direction). Further, the design part dp No. 1 is arranged so that the center of the design part dp be positioned at the 15% position within the range of 0% to 100% on the nail region Ta in vertical direction (y axis direction).

Figure 18:
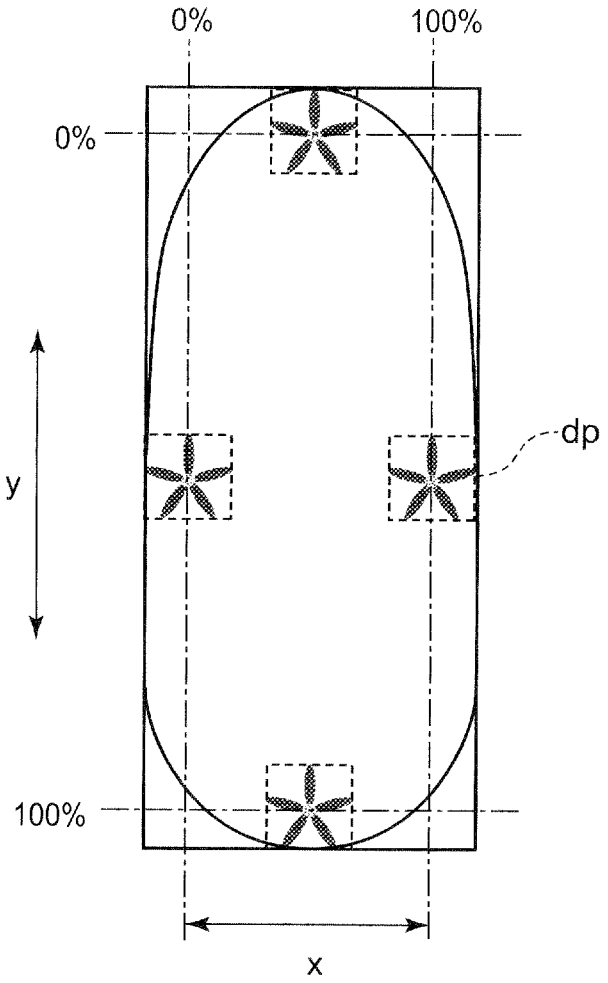
FIG. 18 is a diagram showing an arrangement of the design image e on a long and slender nail region.
Figure 19:
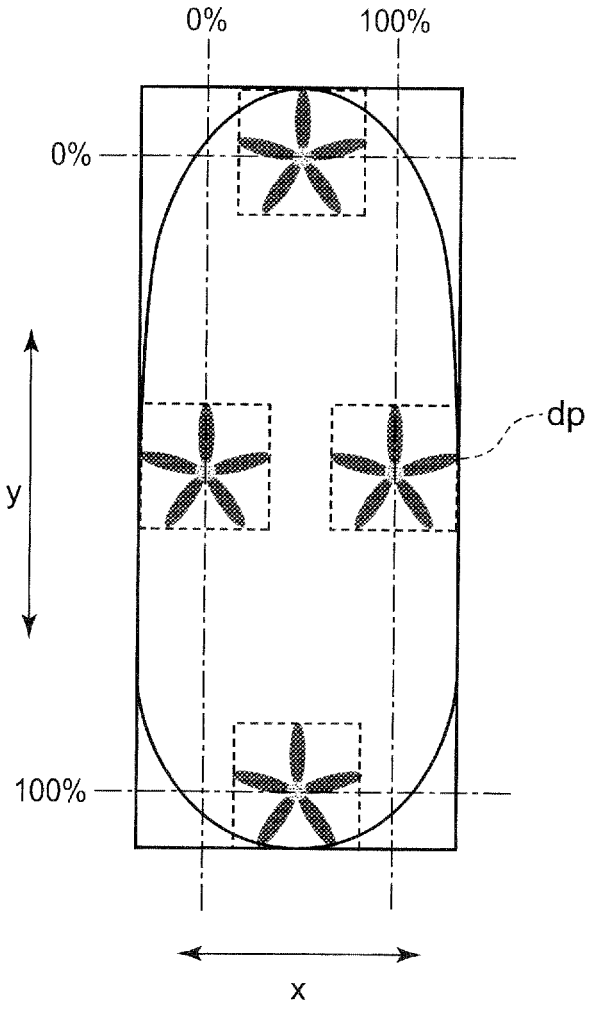
FIG. 19 is an explanatory diagram for explaining how to set 0% positions and 100% positions of the design part No. 1 of the design image e in horizontal direction and vertical direction in FIG. 18.
Figure 20:
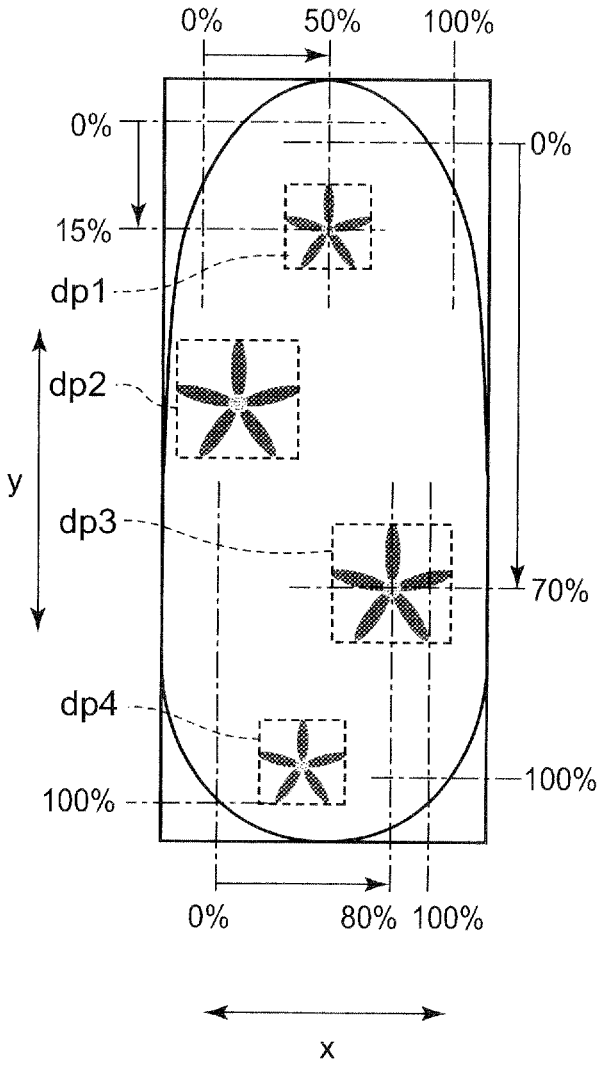
FIG. 20 is an explanatory diagram for explaining how to set 0% positions and 100% positions of the design part No. 3 of the design image e in horizontal direction and vertical direction in FIG. 18.

FIGS. 18 to 20 are explanatory diagrams showing the way to set print size and print position of each design part dp when the nail region Ta of the printing finger U1 of a user is longer and more slender than the standard nail model.

In this case, the part layout calculation section 54 first calculates the print size of each design part dp according to the area of the nail region Ta. Next, each design part dp in the calculate print size is arranged on the nail region Ta, and the position to be 0% and the position to be 100% in the left, right, top and bottom are calculated for each design part dp (see FIG. 18 for the design parts dp of No. 1 and No. 4 in the design image e, and see FIG. 19 for the design parts dp of No. 2 and No. 3). Then, the design parts dp in the calculated print sizes are respectively arranged at the calculated print positions on the nail region Ta (see FIG. 20).

Thereby, even when the nail region Ta of a user is longer and more slender than the standard nail model, each of the design parts dp can be arranged so as to form an approximately same layout as they are being arranged on the standard nail model.

Figure 21:
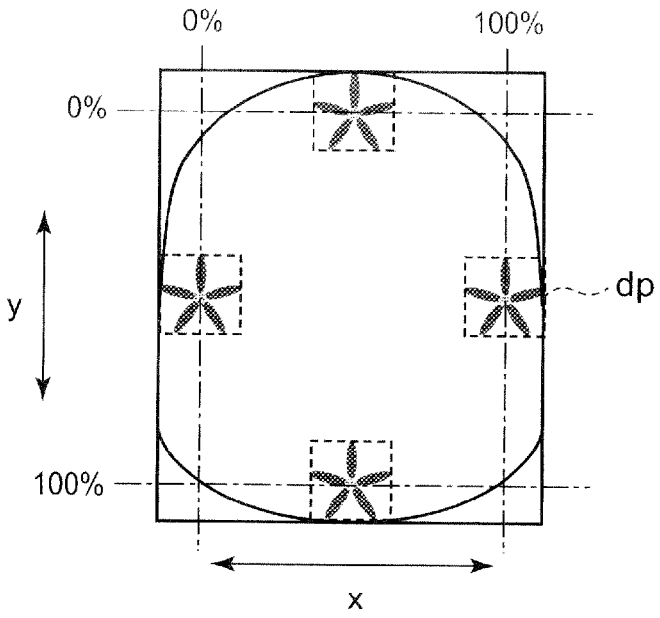
FIG. 21 is a diagram showing an arrangement of the design image e on a wide nail region.
Figure 22:
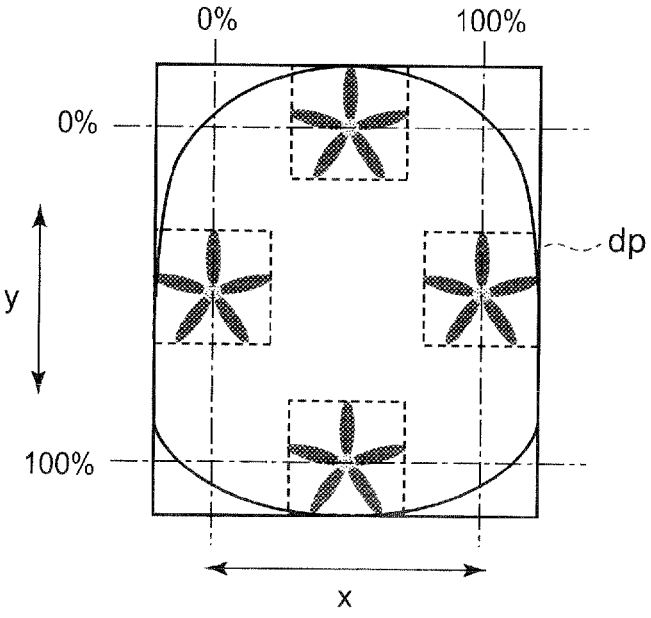
FIG. 22 is an explanatory diagram for explaining how to set 0% positions and 100% positions of the design part No. 1 of the design image e in horizontal direction and vertical direction in FIG. 21.
Figure 23:
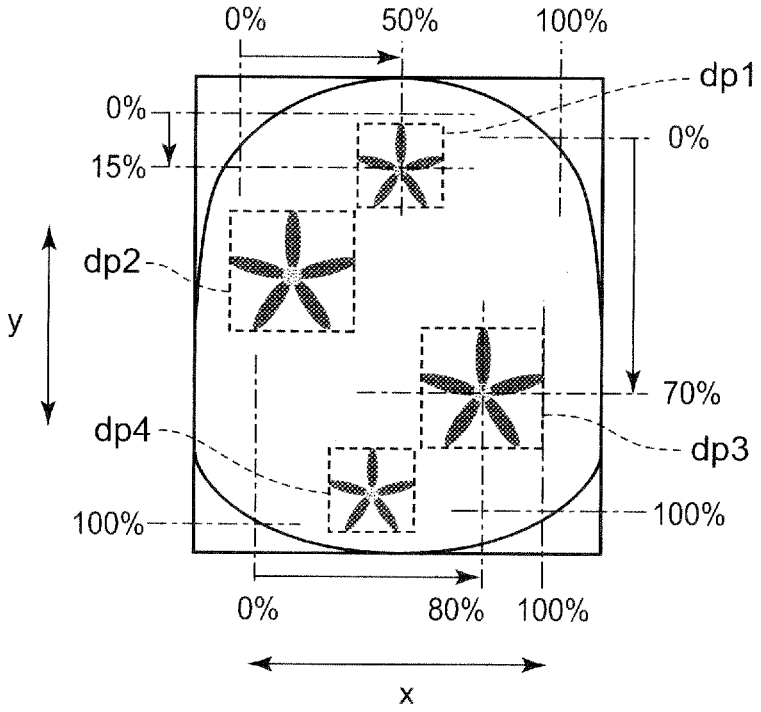
FIG. 23 is an explanatory diagram for explaining how to set 0% positions and 100% positions of the design part No. 3 of the design image e in horizontal direction and vertical direction in FIG. 21.

FIGS. 21 to 23 are explanatory diagrams for showing the way to set print size and print position of each design part dp when the nail region Ta of the printing finger U1 of a user is vertically shorter and horizontally wider comparing to the standard nail model.

In this case, the part layout calculation section 54 first calculates the print size of each design part dp according to the area of the nail region Ta. Next, each design part dp in the calculated print size is arranged on the nail region Ta and the position to be 0% and the position to be 100% in the left, right, top and bottom are calculated for each design part dp (see FIG. 21 for the design parts dp No. 1 and No. 4 in the design image e, and see FIG. 22 for the design parts dp No. 2 and No. 3). Then, the design parts dp in the calculated print sizes are respectively arranged at the calculated print positions on the nail region Ta (see FIG. 23).

Thereby, even when the nail region Ta of a user is vertically shorter and wider than the standard nail model, the design parts dp can be arranged so as to form an approximately same layout as they were being arranged on the standard nail model.

The printing data generation section 55 is a printing data generation unit to generate printing data for performing printing to the nail region Ta of a user based on the print size and print position of each design part dp which are calculated by the part layout calculation section 54 and the image data of each design part dp.

The printing data generated in the printing data generation section 55 is to be output to the main body control section 52.

The main body control section 52 makes the display section 13 display an image in which the printing data is superimposed on the nail region Ta of the finger image of a user as the design confirmation screen 132. Further, the main body control section 52 outputs the printing data to the print section 40 to control the print section 40 so as to perform printing to the nail region Ta according to the printing data.

Next, the print control method carried out in the nail print apparatus 1 of the embodiment will be described with reference to FIG. 15.

When performing the printing in the nail print apparatus 1, a user first turns of the power switch to activate the control device 50.

Figure 15:
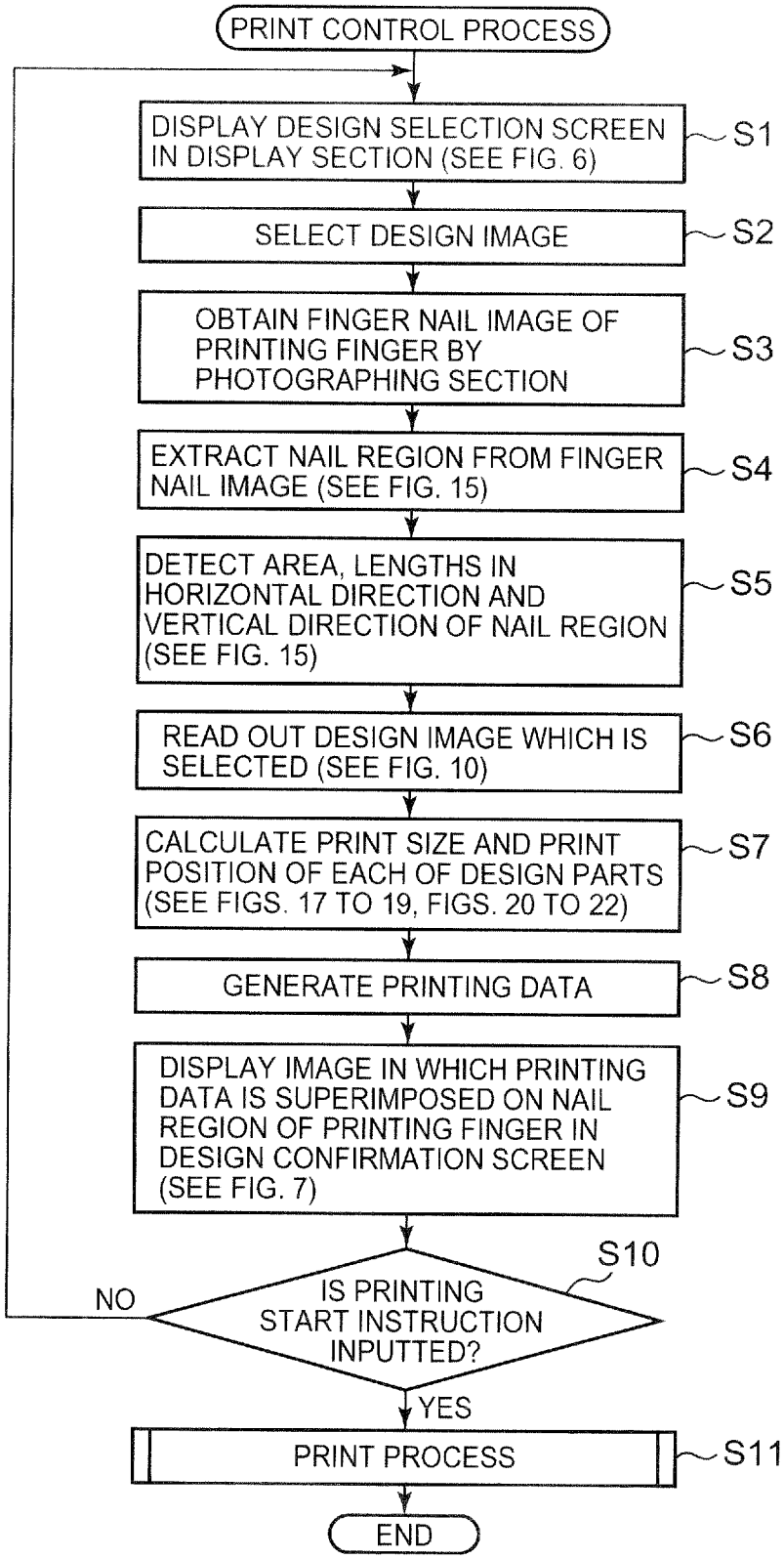
FIG. 15 is a flowchart showing a print control process in the embodiment.

As shown in FIG. 15, the main body control section 52 makes the display section 13 display the design selection screen 131 (see FIG. 6) (step S1). Then, by a user operating an operation button 121 of the operation panel 12 or the like to select the desired design image from the plurality of design images displayed in the design selection screen 131, a selection instruction signal is outputted from the operation panel 12 and one design image is selected (step S2).

Next, the user inserts her/his printing fingers U1 in the printing finger insertion section 20*a* and inserts her/his non-printing finger U2 in the non-printing finger insertion section 20*b* and fixates the printing fingers U1, and then the user operates the print switch.

For example, when a user wishes to perform printing on the nail regions Ta of index finger, middle finger, ring finger and little finger of the left hand, the index finger, middle finger, ring finger and little finger of the left hand are to be inserted in the printing finger insertion section 20*a* so as to be arranged side by side planarly and the thumb is to be inserted in the non-printing finger insertion section 20*b* as shown in FIG. 3. Then, the holding section 20*c* is to be held by being sandwiched by the index finger, middle finger, ring finger and little finger inserted in the printing finger insertion section 20*a* and the thumb inserted in the non-printing finger insertion section 20*b*. In such way, the index finger, middle finger, ring finger and little finger which are the printing fingers U1 are fixated.

When an instruction is inputted from the print switch of the display section 13, the control device 50 first controls the photographing section 30 to photograph the entire printing finger U1 before starting the print operation. Thereby, a finger image of the print finger U1 is obtained (step S3). The nail region information detection section 53 extracts a nail region Ta which becomes the print-target region from the finger image (step S4; see FIG. 16), and detects the area (S), length (W) in horizontal direction (x axis direction) and length (H) in vertical direction (y axis direction) of the nail region Ta (step S5). The detection result of the nail region information detection section 53 is transmitted to the nail region data storage section 512 of the storage section 51 to be stored (see FIG. 17).

Next, the part layout calculation section 54 reads out data (see FIG. 10) of each of the design parts dp which are included in the design image selected in step S2 from the design data storage section 511 (step S6), and then, calculates the print size and print position of each of the design parts dp based on the size data and two pieces of position data of each of the design parts dp which are included in the read design image and the area, length in horizontal direction and length in vertical direction of the nail region Ta of the printing finger U1 of the user which are detected by the above-mentioned nail region information detection section 53 (step S7, see FIGS. 18 to 20).

The printing data generation section 55 generates printing data for performing printing to the nail region Ta of the user (step S8) based on the print size and print position of each of the design parts dp which are calculated by the part layout calculation section 54 and the image data of each of the design parts dp included in the design image which are read out from the above-mentioned design data storage section 511 (step S6).

The printing data which is generated in the printing data generation section 55 is outputted to the main body control section 52, and the main body control section 52 makes the image in which the printing data is superimposed on to the nail region Ta of the finger image of the user be displayed in the display section 13 as a design confirmation screen 132 (see FIG. 7) (step S9). The user confirms the finalized print image by looking at the design confirmation screen 132, and if she/he agrees to perform printing of the print image, the user operates the operation button 121 such as the OK button of the operation panel 12 to input the printing start instruction. The main body control section 52 determines whether the printing start instruction is inputted or not (step S10), and when the main body control section 52 determines that the printing start instruction is inputted (step S10; YES), the main body control section 52 outputs the printing data to the print section 40 and controls the print section 40 to perform printing to the nail region Ta according to the printing data. Thereby, the print process by the print section 40 is started (step S11).

On the other hand, when the user does not operate the OK button or the like and when the main body control section 52 determines that the printing start instruction is not inputted (step S10; NO), the main body control section 52 returns to step S1 and makes the design selection screen 131 be displayed in the display section 13 again and repeats the processes thereafter.

Here, operation with respect to one printing finger U1 has been described. However, for example, when the print process is to be performed to a plurality of printing fingers U1, such as four fingers, at the same time as in the embodiment, the print process is performed for all of the printing fingers U1 by repeating the above process to each of the printing fingers U1.

In such way, the nail print apparatus according to the embodiment (the nail print apparatus 1 of FIG. 1 or the like) includes a storage unit (the design data storage section 511 of FIG. 8) in which a plurality of sets of data relating to a plurality of design parts (the design parts dp of FIG. 9 etc.) constituting each of a plurality of design images are stored, each set of data including size data, position data and image data which are made to correspond with each of the design parts, a photographing unit (the photographing section 30 of FIG. 4 etc.) which obtains a finger image by photographing a finger (the printing finger U1 of FIG. 3), a nail region information detection unit (the nail region information detection section 53 of FIG. 8) which extracts a nail region (the nail region Ta of FIG. 7 etc.) from the finger image which is obtained by the photographing unit and detects an area, a length in horizontal direction and a length in vertical direction of the nail region, a design selection unit (the operation button 121 of FIG. 1) which selects one design image from the design images which are stored in the storage unit, apart layout calculation unit (the part layout calculation section 54 of FIG. 8) which reads out the one design image which is selected by the design selection unit from the storage unit and calculates a print size and a print position of each of the design parts based on the size data and the position data of each of the design parts included in the one design image which is read out and an area, the length in horizontal direction and the length in vertical direction of the nail region which is detected by the nail region information detection unit and a print unit (the printing data generation section 55 of FIG. 8, the print section 40 of FIG. 4 etc.) which performs a printing to the nail region according to printing data which is generated based on the print size and the print position of each of the design parts which are calculated by the part layout calculation unit and image data of each of the design parts included in the one design image which is read out from the storage unit.

In the above nail print apparatus, the size data of each of the design parts (the design parts dp of FIG. 9 etc.) specifies a size of each of the design parts in a relative area ratio of an area of each of the design parts to an area of a standard nail model when the one design image is arranged on the standard nail model, the position data of each of the design parts specifies a position of each of the design parts by a relative positional relation when a length in horizontal direction and a length in vertical direction of the standard nail model are set as standards, and the part layout calculation unit (the part layout calculation section 54 of FIG. 8) calculates the print size and the print position of each of the design parts by substituting the area, the length in horizontal direction and the length in vertical direction of the standard nail model with the area, the length in horizontal direction and the length in vertical direction of the nail region (the nail region Ta of FIG. 7 etc.) which is detected by the nail region information detection unit (the nail region information detection section 53 of FIG. 8).

In the print control method according to the embodiment, photographing (S3 of FIG. 15) a finger (the printing finger U1 of FIG. 3) to obtain a finger image, detecting (S4, S5 of FIG. 15) an area, a length in horizontal direction and a length in vertical direction of a nail region by extracting the nail region (the nail region Ta of FIG. 7 etc.) from the finger image which is obtained in the photographing, calculating (S7 of FIG. 15) a print size and a print position of each of a plurality of design parts (the design parts dp of FIG. 9 etc.) included in one design image based on a size and a position of each of the design parts and the area, the length in horizontal direction and the length in vertical direction of the nail region which are detected in the detecting, when the one design image is selected (S2 of FIG. 15) in a storage unit (the design data storage section 511 of FIG. 8) in which a plurality of sets of data relating to the plurality of design parts constituting each of design images are stored wherein each set of data including size data, position data and image data which are made to correspond with each of the design parts and when the one design image is read out from the storage unit, and performing a printing (S8, S11 of FIG. 15) to the nail region according to printing data which is generated based on the print size and the print position of each of the design parts which are calculated in the calculating and image data of each of the design parts included in the one design image which is read out from the storage unit.

In the above print control method, the size data of each of the design parts (the design parts dp of FIG. 9 etc.) specifies a size of each of the design parts in a relative area ratio of an area of each of the design parts to an area of a standard nail model when the one design image is arranged on the standard nail model, the position data of each of the design parts specifies a position of each of the design parts by a relative positional relation when a length in horizontal direction and a length in vertical direction of the standard nail model are set as standards and in the calculating, the print size and the print position of each of the design parts are calculated by substituting the area, the length in horizontal direction and the length in vertical direction of the standard nail model with the area, the length in horizontal direction and the length in vertical direction of the nail region (the nail region Ta of FIG. 7 etc.) which is detected in the detecting.

As described above, according to the nail print apparatus 1 of the embodiment, data of the design image to be printed on a nail region Ta is constituted of a plurality of design parts dp, and the size data, position data and image data of the design part dp are made to be corresponded with each of the design parts dp to be stored in the design data storage section 511. Further, the print size and print position can be calculated for each of the design parts dp when adjusting the size and shape of the design image according to the area and shape (for example, long shape in vertical direction (see FIG. 20), wide in horizontal direction (see FIG. 23) and the like) of the nail region Ta of a user. Therefore, differently from the case where the entire design image is stored as one piece of data and the printing data is generated by changing the scale of the entire design image, the shape of each of the design parts dp can be prevented from being distorted and the positional relation between the design parts dp and the positional relation between each of the design parts dp and the end portions of the nail region Ta can be prevented form being changed. Thus, the design image can be printed on the nail region Ta of a user being close to the image of the design image which is selected by a user in the design selection screen 131 as much as possible.

Moreover, with respect to the size data of each of the design parts dp, the size of each design part dp is specified in a relative area ratio of the area of each design part dp to the area of the standard nail model when the design image is arranged on the standard nail model, and with respect to the position data of each of the design parts dp, the position of each design part dp is specified in a relative position relation when the length in horizontal direction and the length in vertical direction of the standard nail model are set as the standard, and the part layout calculation section 54 calculates the print size and print position of each design part dp by substituting the area, length in horizontal direction and length in vertical direction of the standard nail model with the area, length in horizontal direction and length in vertical direction of the nail region Ta of a user detected by the nail region information detection section 53. Therefore, the print size and print position of each of the design parts dp can be calculated easily by calculating the area ratio of each design part dp with respect to the nail region Ta and the relative position of each of the design parts dp with respect to the nail region Ta for any kind of nail region Ta having any area and shape.

In the embodiment, the left, right, top and bottom of the standard nail model (or the nail region Ta) is encircled with a frame, and the position of each design part dp in horizontal direction (x axis direction) is the relative position when the position where the center of the design part dp be arranged is set as 0% when the design part dp is arranged on the standard nail model (or the nail region Ta) so that the left end of the design part dp overlaps and matches the left end of the frame of the standard nail model (or the nail region Ta), and the position where the center of the design part dp be arranged is set as 100% when the design part dp is arranged on the standard nail model (or the nail region Ta) so that the right end of the design part dp overlaps and matches the right end of the frame of the standard nail model (or the nail region Ta). However, the way of setting the position to be 0% and the position to be 100% which are the standard for setting the position of each design part dp in horizontal direction (x axis direction) is not limited to the above exemplified method.

For example, the position where the left end of the design part dp be arranged when the design part dp is arranged on the standard nail model (or the nail region Ta) so that the left end of the design part dp overlaps and matches the left end of the frame of the standard nail model may be set as the position to be 0% and the position where the right end of the design part dp be arranged when the design part dp is arranged on the standard nail model (or the nail region Ta) so that the right end of the design part dp overlaps and matches the right end of the frame of the standard nail model (or the nail region Ta) may be set as the position to be 100%.

The above similarly applies to the way of setting the position to be 0% and the position to be 100% which are the standard for setting the position of each design part dp in vertical direction (y axis direction).

Moreover, in the embodiment, data which expresses the area (S) in number of dots and data which expresses the length (W) in horizontal direction (x axis direction) and length (H) in vertical direction (y axis direction) in number of dots are stored as the data of nail region Ta. However, data of the area (S), length (W) in horizontal direction (x axis direction) and length (H) in vertical direction (y axis direction) is not limited to be expressed in number of dots.

Further, in the embodiment, the case where the design data storage section 511 and the nail region data storage section 512 are provided in the storage section 51 of the control device 50 is shown as an example. However, the design data storage section 511 and the nail region data storage section 512 are not limited to be provided in the storage section 51 of the control device 50, and a separate storage section may be provided.

Furthermore, in the embodiment, the nail print apparatus 1 which can perform printing to four fingers at the same time is shown as an example. However, the present invention can be applied to an apparatus which performs printing in order by inserting one finger at a time.

Also in other aspects, the present invention is not limited to the above embodiment, and it is needless to say that the present invention can be changed arbitrarily.

According to the first aspect of the preferred embodiment of the present invention a nail print apparatus includes a storage unit in which a plurality of sets of data relating to a plurality of design parts constituting each of a plurality of design images are stored, each set of data including size data, position data and image data which are made to correspond with each of the design parts, a photographing unit which obtains a finger image by photographing a finger, a nail region information detection unit which extracts a nail region from the finger image which is obtained by the photographing unit and detects an area, a length in horizontal direction and a length in vertical direction of the nail region, a design selection unit which selects one design image from the design images which are stored in the storage unit, a part layout calculation unit which reads out the one design image which is selected by the design selection unit from the storage unit and calculates a print size and a print position of each of the design parts based on the size data and the position data of each of the design parts included in the one design image which is read out and an area, the length in horizontal direction and the length in vertical direction of the nail region which is detected by the nail region information detection unit and a print unit which performs a printing to the nail region according to printing data which is generated based on the print size and the print position of each of the design parts which are calculated by the part layout calculation unit and image data of each of the design parts included in the one design image which is read out from the storage unit.

Preferably, the size data of each of the design parts specifies a size of each of the design parts in a relative area ratio of an area of each of the design parts to an area of a standard nail model when the one design image is arranged on the standard nail model, the position data of each of the design parts specifies a position of each of the design parts by a relative positional relation when a length in horizontal direction and a length in vertical direction of the standard nail model are set as standards, and the part layout calculation unit calculates the print size and the print position of each of the design parts by substituting the area, the length in horizontal direction and the length in vertical direction of the standard nail model with the area, the length in horizontal direction and the length in vertical direction of the nail region which is detected by the nail region information detection unit.

According to a second aspect of the preferred embodiment of the present invention, a print control method includes photographing a finger to obtain a finger image, detecting an area, a length in horizontal direction and a length in vertical direction of a nail region by extracting the nail region from the finger image which is obtained in the photographing, calculating a print size and a print position of each of a plurality of design parts included in one design image based on a size and a position of each of the design parts and the area, the length in horizontal direction and the length in vertical direction of the nail region which are detected in the detecting, when the one design image is selected in a storage unit in which a plurality of sets of data relating to the plurality of design parts constituting each of design images are stored wherein each set of data including size data, position data and image data which are made to correspond with each of the design parts and when the one design image is read out from the storage unit, and performing a printing to the nail region according to printing data which is generated based on the print size and the print position of each of the design parts which are calculated in the calculating and image data of each of the design parts included in the one design image which is read out from the storage unit.

Preferably, the size data of each of the design parts specifies a size of each of the design parts in a relative area ratio of an area of each of the design parts to an area of a standard nail model when the one design image is arranged on the standard nail model, the position data of each of the design parts specifies a position of each of the design parts by a relative positional relation when a length in horizontal direction and a length in vertical direction of the standard nail model are set as standards, and in the calculating, the print size and the print position of each of the design parts are calculated by substituting the area, the length in horizontal direction and the length in vertical direction of the standard nail model with the area, the length in horizontal direction and the length in vertical direction of the nail region which is detected in the detecting.

The present U.S. patent application claims a priority under the Paris Convention of Japanese paten application No. 2010-241708 filed on Oct. 28, 2010, which shall be a basis of correction of an incorrect translation.

Although various exemplary embodiments have been shown and described, the invention is not limited to the embodiments shown. Therefore, the scope of the invention is intended to be limited solely by the scope of the claims that follow.

What is claimed is:

1. A nail print apparatus, comprising:

a storage unit in which a plurality of sets of data relating to a plurality of design parts constituting each of a plurality of design images are stored, each set of data including size data, position data, and image data which are made to correspond with one of the design parts;

a photographing unit which obtains a finger image by photographing a finger;

a nail region information detection unit which extracts a nail region from the finger image which is obtained by the photographing unit and detects an area, a length in a first direction, and a length in a second direction of the nail region, the first direction being perpendicular to the second direction; and a part layout calculation unit which (A) reads out one design image which is selected by a user from the storage unit and (B) calculates a print size and a print position of each of the design parts based on (i) the size data and the position data of each of the design parts included in the one design image which is read out and (ii) the area, the length in the first direction, and the length in the second direction of the nail region which are detected by the nail region information detection unit;

wherein:

the size data of each of the design parts indicates a relative area ratio of an area of each of the design parts to an area of a standard nail model when the one design image is arranged on the standard nail model;

the position data of each of the design parts indicates a position ratio of each of the design parts to a length in the first direction and a length in the second direction of the standard nail model when the length in the first direction and the length in the second direction of the standard nail model are set as standards;

the part layout calculation unit calculates the print size and the print position of each of the design parts by substituting the area, the length in the first direction, and the length in the second direction of the standard nail model with the area, the length in the first direction, and the length in the second direction of the nail region which is detected by the nail region information detection unit;

the print size of each of the design parts is obtained by multiplying, by the area of the nail region, the area ratio which is indicated by the size data of each of the design parts;

the print position of each of the design parts in the first direction is obtained by multiplying, by the length of the nail region in the first direction, the position ratio in the first direction of each of the design parts to the length in the first direction of the standard nail model which is indicated by the position data of each of the design parts; and the print position of each of the design parts in the second direction is obtained by multiplying, by the length of the nail region in the second direction, the position ratio in the second direction of each of the design parts to the length in the second direction of the standard nail model which is indicated by the position data of each of the design parts.

2. The nail print apparatus according to claim 1, further comprising:

a printing data generation unit which generates printing data to be printed in the nail region based on the print size and the print position of each of the design parts which are calculated by the part layout calculation unit, and image data of each of the design parts included in the one design image which is read out from the storage unit; and a print unit which performs a printing to the nail region according to the printing data generated by the printing data generation unit.

3. A print control method, comprising:

photographing a finger to obtain a finger image;

detecting an area, a length in a first direction, and a length in a second direction of a nail region by extracting the nail region from the finger image which is obtained in the photographing, the first direction being perpendicular to the second direction; and calculating a print size and a print position of each of a plurality of design parts included in one design image based on a size and a position of each of the design parts and the area, the length in the first direction, and the length in the second direction of the nail region which are detected in the detecting, when the one design image is selected in a storage unit in which a plurality of sets of data relating to a plurality of design parts constituting each of design images are stored, wherein each set of data includes size data, position data, and image data which are made to correspond with one of the design parts, and when the one design image is read out from the storage unit;

wherein:

the size data of each of the design parts indicates a relative area ratio of an area of each of the design parts to an area of a standard nail model when the one design image is arranged on the standard nail model;

the position data of each of the design parts indicates a position ratio of each of the design parts to a length in the first direction and a length in the second direction of the standard nail model when the length in the first direction and the length in the second direction of the standard nail model are set as standards;

in the calculating, the print size and the print position of each of the design parts are calculated by substituting the area, the length in the first direction, and the length in the second direction of the standard nail model with the area, the length in the first direction, and the length in the second direction of the nail region which is detected by the nail region information detection unit;

the print size of each of the design parts is obtained by multiplying, by the area of the nail region, the area ratio which is indicated by the size data of each of the design parts;

the print position of each of the design parts in the first direction is obtained by multiplying, by the length of the nail region in the first direction, the position ratio in the first direction of each of the design parts to the length in the first direction of the standard nail model which is indicated by the position data of each of the design parts; and the print position of each of the design parts in the second direction is obtained by multiplying, by the length of the nail region in the second direction, the position ratio in the second direction of each of the design parts to the length in the second direction of the standard nail model which is indicated by the position data of each of the design parts.

4. The print control method according to claim 3, further comprising:

generating printing data to be printed in the nail region based on the print size and the print position of each of the design parts which are calculated in the calculating, and image data of each of the design parts included in the one design image which is read out from the storage unit; and printing on the nail region according to the printing data generated in the generating.

* * * * *